US006622498B2

(12) United States Patent
Park et al.

(10) Patent No.: US 6,622,498 B2
(45) Date of Patent: Sep. 23, 2003

(54) METHOD FOR DEFROSTING REFRIGERATOR WITH TWO EVAPORATOR

(75) Inventors: Joon Hyung Park, Seoul (KR); Jin Koo Park, Kyonggi-do (KR); Yang Gyu Kim, Seoul (KR); Se Young Kim, Seoul (KR); Yin Young Hwang, Kyonggi-do (KR); Sang Ho Seo, Kyonggi-do (KR); Eui Yeop Chung, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/135,453

(22) Filed: May 1, 2002

(65) Prior Publication Data

US 2002/0166331 A1 Nov. 14, 2002

(30) Foreign Application Priority Data

May 8, 2001 (KR) ..... P2001-24857
May 8, 2001 (KR) ..... P2001-24858
May 8, 2001 (KR) ..... P2001-24860
May 8, 2001 (KR) ..... P2001-24931

(51) Int. Cl.[7] ..... F25D 21/06
(52) U.S. Cl. ..... 62/154; 62/155
(58) Field of Search ..... 62/154, 155, 151, 62/152, 156, 157, 234

(56) References Cited

U.S. PATENT DOCUMENTS 6,058,723 A * 5/2000 Kusunoki et al. ..... 62/156

FOREIGN PATENT DOCUMENTS

JP 10311659 A * 11/1998 ..... F25D/21/06

* cited by examiner

*Primary Examiner*—Chen Wen Jiang
(74) *Attorney, Agent, or Firm*—Fleshner & Kim, LLP

(57) ABSTRACT

The present invention relates to a method for defrosting a refrigerator with two evaporators, and more particularly, to a method for defrosting a refrigerator with two evaporators, in which the two evaporators are operated on the same time when defrosting time points of the two evaporators are close.

Moreover, when it is intended that the freezing chamber evaporator is defrosted, after the freezing chamber temperature and the storage chamber temperature are dropped to lower limits of temperature ranges, the freezing chamber evaporator is defrosted, and when the storage chamber is operative in a kimchi fermenting mode for fermenting kimchi, it is made that the storage chamber evaporator is not defrosted even if the storage chamber evaporator reaches to the defrosting period.

20 Claims, 11 Drawing Sheets

METHOD FOR DEFROSTING REFRIGERATOR WITH TWO EVAPORATOR

This application claims the benefit of the Korean Application Nos. P2001-24857, 24931, 24858, and 24860, all of which are filed on May 8, 2001, and hereby incorporated by reference.

BACKGROUND OF THE INVENTION

1. Field of the Invention

The present invention relates to a method for defrosting a refrigerator with two evaporators, in which defrosting periods of a freezing chamber evaporator and a refrigerating chamber evaporator preset at a controlling part are changed for defrosting the two evaporators on the same time when defrosting operation time points of the two evaporators come close.

2. Background of the Related Art

The refrigerator stores food in a frozen state, or food, such as vegetables and kimchi, in a low temperature state. A related art refrigerator will be explained with reference to FIG. 1. FIG. 1 illustrates a related art refrigerator with two evaporators, schematically.

Referring to FIG. 1, the refrigerator is provided with a freezing chamber 6, and a first storage chamber 7 and a second storage chamber 8. There are a freezing chamber evaporator 6*a* at one side of the freezing chamber 6, and a storage chamber evaporator 7*a* at one side of the storage chambers 7 and 8. There are a freezing chamber fan 6*b* and a defrosting heater 6*c* adjacent to the freezing chamber evaporator 6*a*, and there are a storage chamber fan 7*b* and a defrosting heater 7*c* adjacent to the storage chamber evaporator 7*a*. There are a compressor 1, a condenser 2, a three way valve 3, and respective expansion devices 4 and 5 on outside of the freezing chamber 6*b* and the storage chamber 7 and 8.

There are temperature sensors (not shown) fitted to the freezing chamber 6 and the storage chambers 7 and 8, for sensing and providing temperatures of the freezing chamber 6 and the storage chambers 7 and 8 to a controlling part (not shown).

In order to maintain temperatures of the freezing chamber 6 and the storage chambers 7 and 8, there are upper limits and lower limits of the temperatures of the freezing chamber 6 and the storage chambers 7 and 8 set at the controlling part. A range between the upper temperature limit and the lower temperature limit is called as a preset temperature range.

Moreover, respective storage chambers 7 and 8 are operative in a vegetable or fruit storage mode, a kimchi storage mode, or a kimchi fermenting mode depending on press of buttons by the user. The temperature ranges of the storage chambers 7 and 8 are required to be set to differ with the storage mode, the kimchi storage mode, or the fermenting mode. For an example, the storage chambers 7 and 8 are operative at a temperature range of approx. −1~3° C. in the storage mode, approx. 19~21° C. in the fermenting mode.

The operation of the foregoing refrigerator with two evaporators will be explained.

High temperature high pressure refrigerant compressed at the compressor 1 is provided to a condenser 2, and the refrigerant condensed at the condenser 2 is provided to the three way valve 3. If the temperatures of the freezing chamber 6 and the storage chambers 7 and 8 are not within the temperature ranges preset at the controlling part, the three way valve is opened in a R/F cycle mode, when the refrigerator conducts the R/F cycle in which the refrigerant, passed through the compressor 1 and the condenser 2, flows through the three way valve 3, the second expansion device 5, the storage chamber evaporator 7*a*, and the freezing chamber evaporator 6*a* in succession.

If the temperatures of the storage chambers 7 and 8 are within the temperature ranges preset at the controlling part, but the temperature of the freezing chamber 6 is not within the temperature range preset at the controlling part, the three way valve 3 is opened in an F cycle mode, when the refrigerant, passed through the compressor 1 and the condenser 2, flows through the three way valve 3, the first expansion device 4, and the freezing chamber evaporator 6*a* in succession.

Of course, if all the temperatures of the freezing chamber 6 and the storage chambers 7 and 8 are within the temperature ranges preset at the controlling part, operation of the compressor 1 is stopped, to stop flow of the refrigerant.

There is frost formed on the evaporators 6*a* and 7*a* as the refrigerator is thus operative for a prolonged time period in the R/F cycle or in the F cycle. Since the frost drops thermal efficiencies of the evaporators, defrosting operation is conducted for removing the frost at the evaporators.

For this defrosting operation, there are defrosting periods for respective evaporators 6*a* and 7*a* preset at the controlling part for carrying out the defrosting operation periodically. That is, the controlling part accumulates an operation time period of the compressor 1, to carry out the defrosting operation of the evaporators independently, once the operation time period is accumulated to a preset time period. For an example, the defrosting operation of the storage chamber evaporator 7*a* is carried out whenever the accumulated time period of the compressor 1 is 10 hours, and the defrosting operation of the freezing chamber evaporator 6*a* is carried out whenever the accumulated time period of the compressor 1 is 22 hours.

When the accumulated time period of the compressor 1 reaches to the defrosting period preset at the controlling part, the refrigerating cycle is stopped at the time point of defrosting operation, and the defrosting heaters 6*c* and 7*c* provided adjacent to respective evaporators are put into operation, for defrosting the frost on the evaporators. Upon a pause time period is passed after the defrosting operation of the evaporators are finished, the compressor is put into operation, to operate the refrigerator in the F cycle or in the R/F cycle.

In the meantime, for defrosting the freezing chamber evaporator 6*a*, it is required that the defrosting is carried out only when the refrigerating cycle is finished to stop the compressor 1 regardless of the operation of the refrigerator being in the F cycle or R/F cycle. This is because the refrigerant flows into the freezing chamber evaporator 6*a* regardless of the operation of the refrigerator being in the F cycle or R/F cycle.

In comparison to this, for defrosting the storage chamber evaporator 7*a*, though defrosting of the storage chamber evaporator can be carried out without stopping the compressor 1 if the refrigerator is operative in the F cycle, it is required that the defrosting of the storage chamber evaporator 7*a* is carried out only when the refrigerator finishes the R/F cycle to stop the compressor if the refrigerator is operative in the R/F cycle.

However, because defrosting of the freezing chamber evaporator 6*a* and the storage chamber evaporator 7*a* is independent, which are operative according to the accumulated time period of the compressor 1, there has been a problem in that, even if one of the evaporators is defrosted not so long ago, the other evaporator comes into a defrosting period.

For an example, if the storage chamber evaporator 7*a* reaches to a defrosting period during the refrigerator is operative in the R/F cycle, the defrosting of the storage chamber evaporator is carried out when the compressor 1 is stopped as the R/F cycle is finished. Then, if the freezing chamber evaporator 6*a* reaches to the defrosting time period within a short time period from the defrosting of the storage chamber evaporator, it is required that the defrosting is carried out when the compressor 1 is stopped as the R/F cycle is finished.

Eventually, the frequent stop and starting of the compressor, not only causes a pressure loss of the compressor, but also increases power consumption of the refrigerator.

Moreover, if the defrosting to the freezing chamber evaporator 6*a* is carried out in a state temperatures of the storage chambers and the freezing chamber are close the upper temperature limits of the preset temperature ranges, the temperatures of the storage chambers 7 and 8 and the freezing chamber 6 rise above the upper temperature limits of the preset temperature ranges from a time point the defrosting of the freezing chamber evaporator starts to a time point the defrosting of the freezing chamber evaporator starts again, that cause to required much power for dropping the temperatures of the freezing chamber 6 and the storage chambers 7 and 8 down to the preset temperature ranges.

Moreover, the operation of the freezing chamber and the storage chambers outside of the preset temperature ranges result in failure of maintaining the temperatures of the freezing chamber and the storage chambers with fixed ranges.

In view of current trend of refrigerator technologies, since it appears that maintaining inherent taste of food, such as kimchi, and reducing power consumption of the refrigerator by maintaining temperatures of the freezing chamber and the storage chambers are key points of technical capability, measures for those are required.

SUMMARY OF THE INVENTION

Accordingly, the present invention is directed to a method for defrosting a refrigerator with two evaporators that substantially obviates one or more of the problems due to limitations and disadvantages of the related art.

An object of the present invention is to provide a method for defrosting a refrigerator with two evaporators for improving power consumption of the refrigerator and prevent a pressure loss of a compressor.

Another object of the present invention is to provide a method for defrosting a refrigerator with two evaporators, for stable maintenance of temperatures of a freezing chamber and storage chambers within preset ranges.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, in defrosting a refrigerator with two evaporators, the present invention suggests determining a defrosting time point of the other evaporator when one of the evaporators reaches to a defrosting time point for defrosting the two evaporators on the same time if the defrosting time points of the two evaporators are close, or defrosting the two evaporators separately if not.

Moreover, in the present invention, when the freezing chamber evaporator is defrosted, it is designed that the defrosting is carried out after temperatures of the freezing chamber and the storage chambers are lowered to lower limits in advance, and when all the storage chambers are operative in kimchi fermenting modes, it is designed that no defrosting of the storage chamber evaporator is made even if the storage chamber evaporator reaches to a defrosting time period, for preventing unnecessary defrosting.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Figure 1:
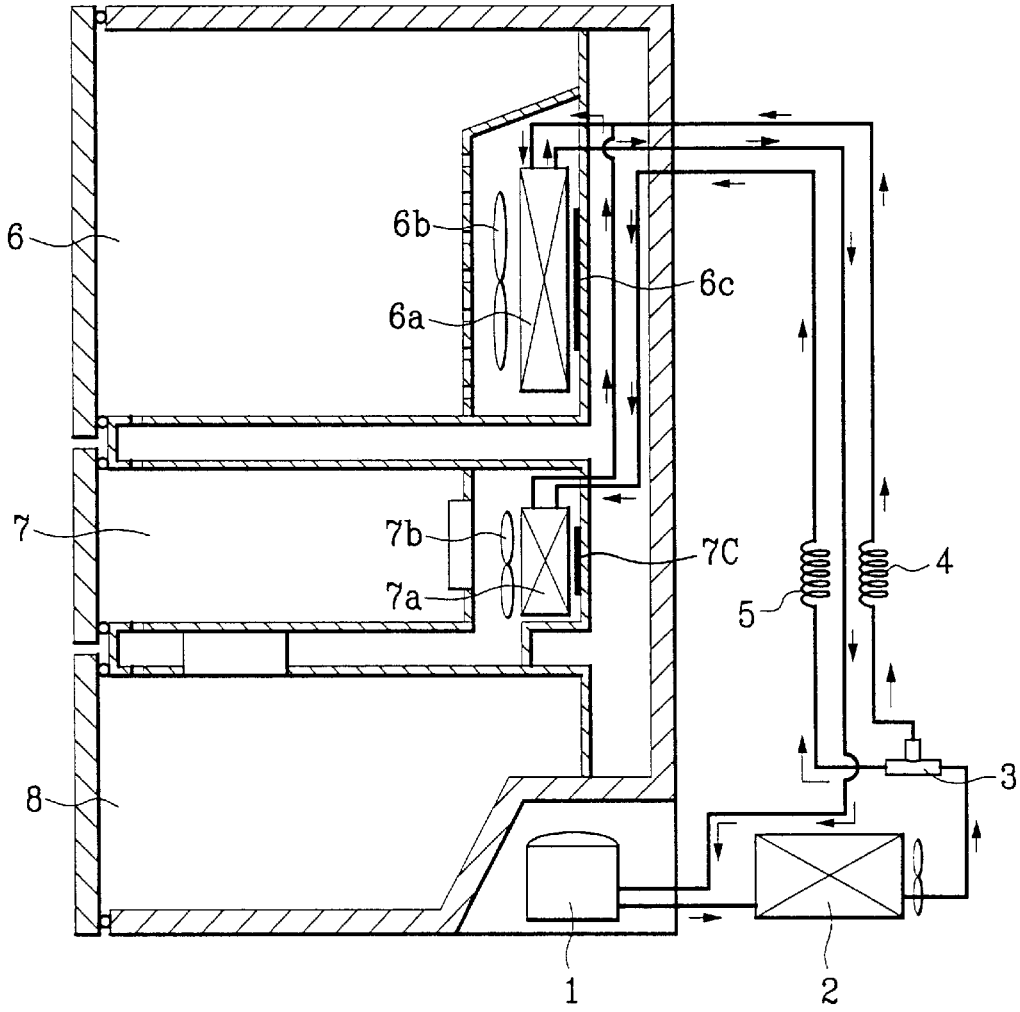
FIG.1 Prior Art
FIG. 1 illustrates a related art refrigerator with two evaporators, schematically.

Reference will now be made in detail to the preferred embodiments of the present invention, examples of which are illustrated in the accompanying drawings.

In defrosting a refrigerator with two evaporators, the present invention suggests determining a defrosting time point of the other evaporator when one of the evaporators reaches to a defrosting time point for defrosting the two evaporators on the same time if the defrosting time points of the two evaporators are close, or defrosting the two evaporators separately if not.

Moreover, in the present invention, when the freezing chamber evaporator is defrosted, it is designed that the defrosting is carried out after temperatures of the freezing chamber and the storage chambers are lowered to lower limits in advance, and when all the storage chambers are operative in kimchi fermenting modes, it is designed that no defrosting of the storage chamber evaporator is made even if the storage chamber evaporator reaches to a defrosting time period, for preventing unnecessary defrosting.

The refrigerator of the present invention has a freezing chamber fan and a storage chamber fan fitted in the vicinity of a freezing chamber evaporator and a storage chamber evaporator.

A defrosting time point of the refrigerator is determined with reference to an operation time period of the fan in the vicinity of respective evaporators, or with reference to an operation time period of the compressor.

The first embodiment and a variation thereof of the present invention progress the defrosting with reference to an accumulated operation time period of fan, which will be explained with reference to FIGS. 2A–5B.

Circles on straight lines in FIGS. 2A–3C represent defrosting time points of evaporators, and downward arrows from the circles represent modified defrosting time points.

The first embodiment of the present invention relates to defrosting of evaporators with reference to accumulated operation time periods of the storage chamber fan.

After defrosting periods of the freezing chamber evaporator 6*a* and the storage chamber evaporator 7*a* are set at the controlling part in advance, the controlling part accumulates operation time periods of the freezing chamber evaporator 6*a* and the storage chamber evaporator 7*a*, for defrosting the evaporator when the accumulated time period of the fan reaches to the defrosting period of the evaporator set at the controlling part in advance.

It is assumed that Df denotes the defrosting time period of the freezing chamber evaporator 6*a*, and Sf denotes an operation time period of the storage chamber evaporator fan 7*b* accumulated from a time point the defrosting of the freezing chamber evaporator 6*a* is finished.

If a time point P1 the storage chamber evaporator 7*a* is reached to the defrosting time period meets a condition of Df−Sf<Df/4, both the freezing chamber evaporator 6*a* and the storage chamber evaporator 7*a* are defrosted on the same time, if the time point P1 the storage chamber evaporator 7*a* is reached to the defrosting time period meets a condition of Df/4<Df−Sf<Df/2, after operation of the freezing chamber evaporator 6*a* is extended by ½ of a time period from the defrosting time period reaching time point P1 to the next defrosting time point of the freezing chamber evaporator 6*a*, both the freezing chamber evaporator 6*a* and the storage chamber evaporator 7*a* are defrosted on the same time, or if a time point P1 the storage chamber evaporator 7*a* is reached to the defrosting time period meets a condition of Df/2<Df−Sf, only the storage chamber evaporator 7*a* is defrosted.

The foregoing defrosting method will be explained in more detail.

Figure 2A:
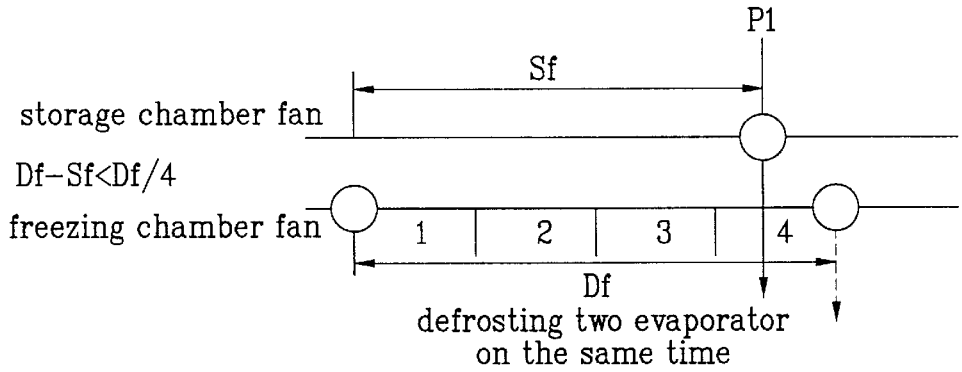
FIGS. 2A, 2B and 2C illustrate a diagram showing a method for defrosting respective evaporators according to an accumulated operation time period of a storage chamber fan in accordance with a first preferred embodiment of the present invention.

Referring to FIG. 2A, if the storage chamber evaporator 7*a* reaches to the defrosting period, before defrosting the storage chamber evaporator, an operation time period Sf of the storage chamber fan 7*b* is determined. That is, if it is determined that the time point P1 the storage chamber evaporator 7*a* is reached to the defrosting time period is within a fourth section of four equally divided defrosting periods of the freezing chamber evaporator 6*a* (Df−Sf<Df/4), the two evaporators are defrosted on the same time.

The time point P1 the storage chamber evaporator is reached to the defrosting time period meets a condition of Df−Sf<Df/4, either the two evaporators 6*a* and 7*a* are defrosted at a time point the storage chamber evaporator 7*a* is reached to the defrosting time period as shown in a solid line arrow in FIG. 2A, or the two evaporators are defrosted at a time point the freezing chamber evaporator 6*a* is reached to the defrosting period as shown in a dashed line arrow in FIG. 2A.

According to this, an occasion is prevented, when the freezing chamber evaporator 6*a* is defrosted within a short time period the storage chamber evaporator 7*a* is defrosted.

Figure 2B:
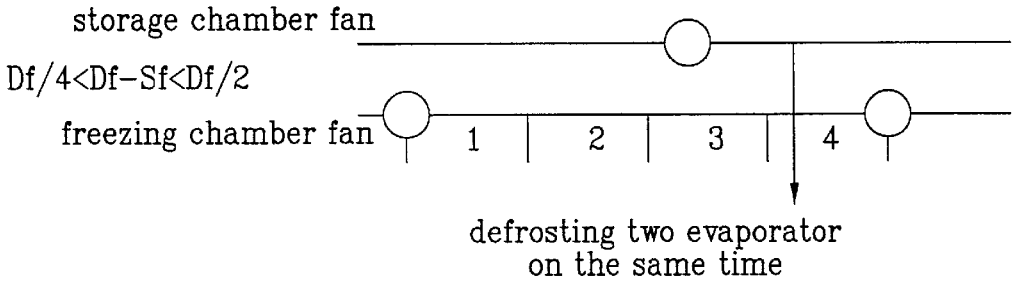

Or, if the time point P1 the storage chamber evaporator 7*a* is reached to the defrosting time period is determined to be within a third section of the four equally divided defrosting periods of the freezing chamber evaporator 6*a* (Df/4<Df−Sf<Df/2) as shown in FIG. 2B, the two evaporators are defrosted on the same time.

In this instance, by dividing a time period from the defrosting period reaching time point P1 to the next defrosting time point, extending operation of the storage chamber evaporator 7*a* by the one equally divided time period, and shortening operation of the freezing chamber evaporator 6*a* by the other one equally divided time period, the two evaporators can be defrosted on the same time as shown in FIG. 2B. Of course, it can be noted that after operation of the storage chamber evaporator is extended for a preset time period, the two evaporators may be defrosted on the same time.

Referring to FIGS. 2A–2B, if it is determined that the defrosting time points of the storage chamber evaporator 7*a* and the freezing chamber evaporator 6*a* are close, the two evaporators are made to be defrosted on the same time.

Accordingly, it is possible that frequent repetition of an operation is prevented, in which the compressor 1 stops for prevention of flow of refrigerant to the freezing chamber evaporator when the defrosting starts in the middle of R/F cycle operation of the refrigerator, and starts again for cooling down.

Figure 2C:
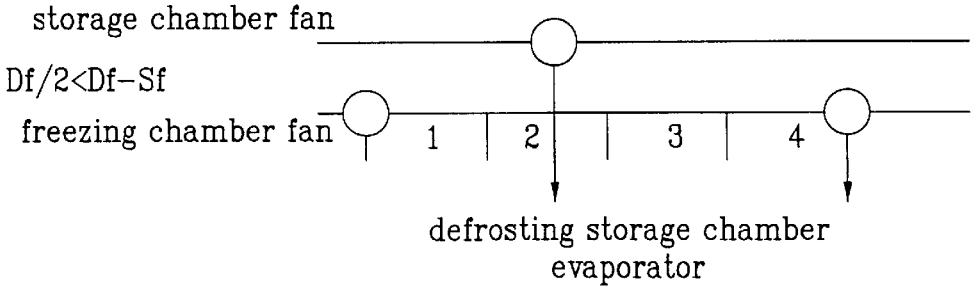

Referring to FIG. 2C, if the defrosting time point of the freezing chamber evaporator 6*a* is too far from the defrosting time point of the storage chamber evaporator 7*a*, the evaporators are defrosted, independently.

In the foregoing refrigerator defrosting methods, it can be noted that the operation methods shown in FIGS. 2A–2C may be applied independently, or the three operation methods may be applied on the same time in the defrosting of the refrigerator.

A variation of the first embodiment of the present invention is related to a defrosting method of an evaporator with reference to an accumulated operation time period of the freezing chamber fan 6*b*, which will be explained with reference to FIGS. 3A, 3B, and 3C.

It is assumed that Dr denotes the defrosting time period of the storage chamber evaporator 7*a*, and Sr denotes an operation time period of the freezing chamber evaporator fan 6*b* accumulated from a time point the defrosting of the storage chamber evaporator 7*a* is finished.

If a time point P2 the freezing chamber evaporator 6*a* is reached to the defrosting time period meets a condition of Dr−Sr<Dr/4, both the freezing chamber evaporator 6*a* and the storage chamber evaporator 7*a* are defrosted on the same time, if the time point P2 the freezing chamber evaporator 6*a* is reached to the defrosting time period meets a condition of Dr/4<Dr−Sr<Dr/2, after operation of the freezing chamber evaporator 6*a* is extended by ½ of a time period from the defrosting period reaching time point P2 to the next defrosting time point of the storage chamber evaporator 7*a*, the two evaporators 6*a* and 7*a* are defrosted on the same time, or if a time point P2 the freezing chamber evaporator 6*a* is reached to the defrosting time period meets a condition of Dr/2<Dr−Sr, only the freezing chamber evaporator 6*a* is defrosted.

The foregoing defrosting method will be explained in more detail.

Figure 3A:
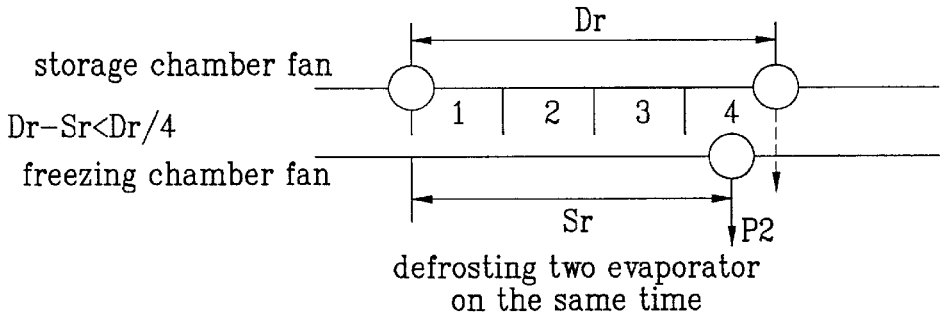
FIGS. 3A, 3B and 3C illustrate a diagram showing a method for defrosting respective evaporators according to an accumulated operation time period of a freezing chamber fan as a variation of FIGS. 2A, 2B and 2C.

Referring to FIG. 3A, if the freezing chamber evaporator 6*a* reaches to the defrosting time period, before defrosting the freezing chamber evaporator, an operation time period Sr of the freezing chamber fan 6*b* is determined. That is, if it is determined that the time point P2 the freezing chamber evaporator 6*a* is reached to the defrosting time period is within a fourth section of four equally divided defrosting periods of the storage chamber evaporator 7*a* (Dr−Sr<Dr/4), the two evaporators 6*a*, and 7*a* are defrosted on the same time.

The time point P2 the freezing chamber evaporator 6*a* is reached to the defrosting time period meets a condition of Dr−Sr<Dr/4, either the two evaporators 6*a* and 7*a* are defrosted at a time point the freezing chamber evaporator 6*a* is reached to the defrosting time period as shown in FIG. 3A, or the two evaporators are defrosted at a time point the storage chamber evaporator 7*a* is reached to the defrosting period as shown in a dashed line arrow in FIG. 3A.

According to this, an occasion is prevented, when the storage chamber evaporator 7*a* is defrosted within a short time period the freezing chamber evaporator 6*a* is defrosted.

Figure 3B:
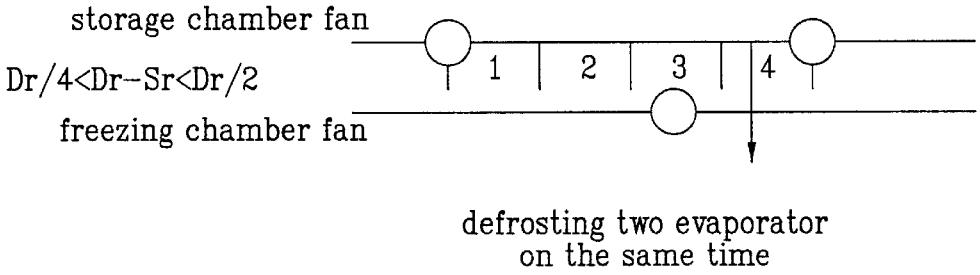

Or, if the time point P2 the freezing chamber evaporator 6*a* is reached to the defrosting time period is determined to be within a third section of the four equally divided defrosting periods of the storage chamber evaporator 7*a* (Dr/4<Dr−Sr<Dr/2) as shown in FIG. 3B, the two evaporators are defrosted on the same time.

In this instance, by dividing a time period from the defrosting period reaching time point P2 to the next defrosting time point, extending operation of the freezing chamber evaporator 6*a* for the one equally divided time period, and shortening operation of the storage chamber evaporator 7*a* by the other one equally divided time period, the two evaporators can be defrosted on the same time as shown the solid line arrow in FIG. 3B. Of course, it can be noted that, after operation of the storage chamber evaporator is extended by a preset time period, the two evaporators may be defrosted on the same time.

Referring to FIGS. 3A–3B, if it is determined that the defrosting time points of the storage chamber evaporator 7*a* and the freezing chamber evaporator 6*a* are close, the two evaporators are made to be defrosted on the same time.

Accordingly, it is possible that frequent repetition of an operation is prevented, in which the compressor 1 stops for prevention of flow of refrigerant to the freezing chamber evaporator when the defrosting starts in the middle of R/F cycle operation of the refrigerator, and starts again for cooling down.

Figure 3C:
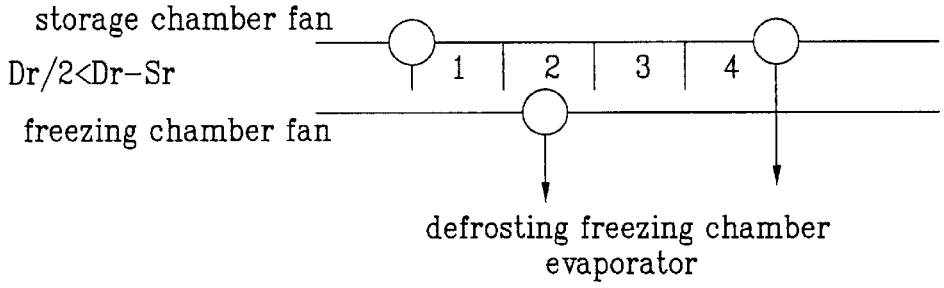

Referring to FIG. 3C, if the defrosting time point of the freezing chamber evaporator 6*a* is too far from the defrosting time point of the storage chamber evaporator 7*a*, the evaporators are defrosted, independently.

In the foregoing refrigerator defrosting methods, it can be noted that the operation methods shown in FIGS. 3A–3C may be applied independently, or, as explained, the three operation methods may be applied on the same time in the defrosting of the refrigerator.

Figure 4:
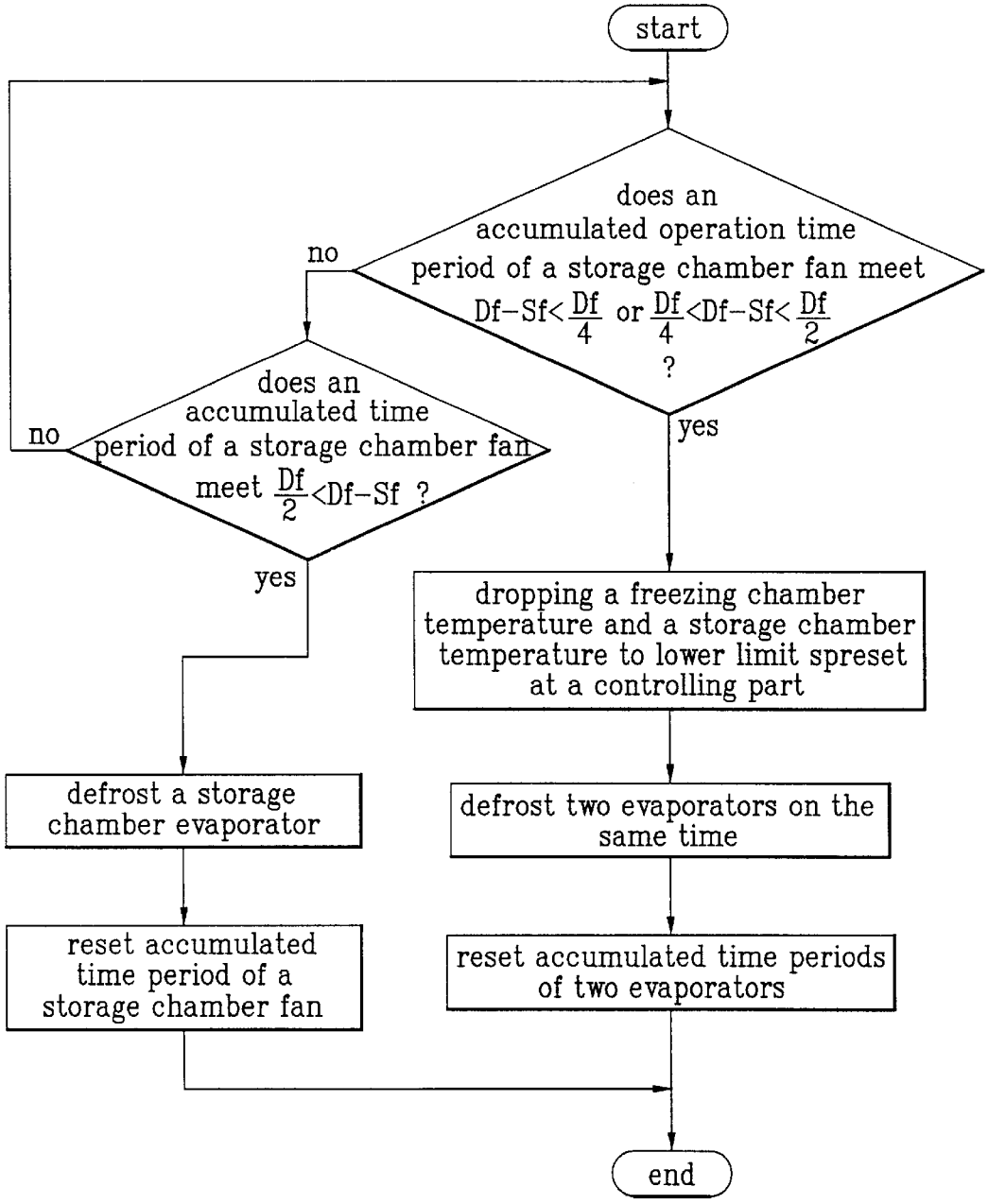
FIG. 4 illustrates a diagram showing a method for defrosting refrigerator after temperatures of a freezing chamber and storage chambers to lower limit temperatures in accordance with a first preferred embodiment of the present invention.

Referring to FIG. 4, if it is intended to defrost the freezing chamber evaporator 6*a*, after temperatures of the freezing chamber 6 and the storage chambers 7 and 8 are dropped to lower limits of preset temperature ranges set at the controlling part, defrosting of the freezing chamber evaporator 6*a* is carried out. In this instance, since the refrigerant passes through the freezing chamber evaporator 6*a* even if the refrigerator is in operation in any one of the F or R/F cycle, it is required that either the two evaporators 6*a* and 7*a* are defrosted on the same time, or the compressor 1 is stopped if the freezing chamber evaporator 6*a* only is defrosted.

Accordingly, as the freezing chamber 6 and the storage chambers 7 and 8 heat exchange with outside air from a time defrosting of the freezing chamber evaporator 6*a* starts to a time cooling operation of the freezing chamber evaporator 6*a* starts again, rising of the freezing chamber temperature and the storage chamber temperature over upper limits of the preset temperature ranges is prevented.

Eventually, as stable maintenance of the freezing chamber 6 temperature and the storage chamber 7, and 8 temperatures within preset temperature ranges is possible, inherent tastes of food, such as meats and kimchi stored in the freezing chamber 6 and the storage chambers can be maintained for a more long time.

Figure 5A:
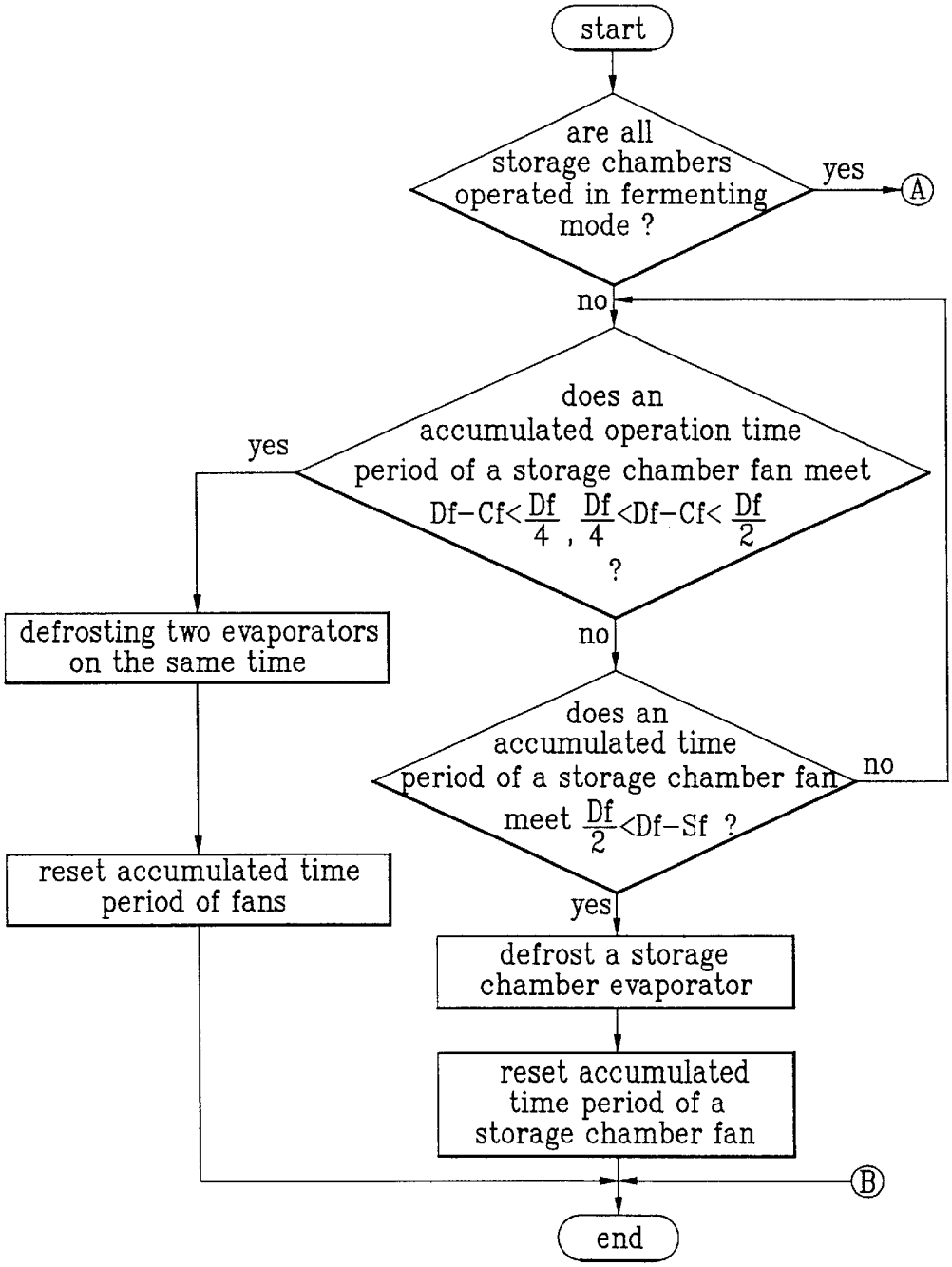
FIGS. 5A and 5B illustrate a diagram showing a method for defrosting refrigerator when all the storage chambers are operative in fermenting modes in accordance with a first preferred embodiment of the present invention.
Figure 5B:
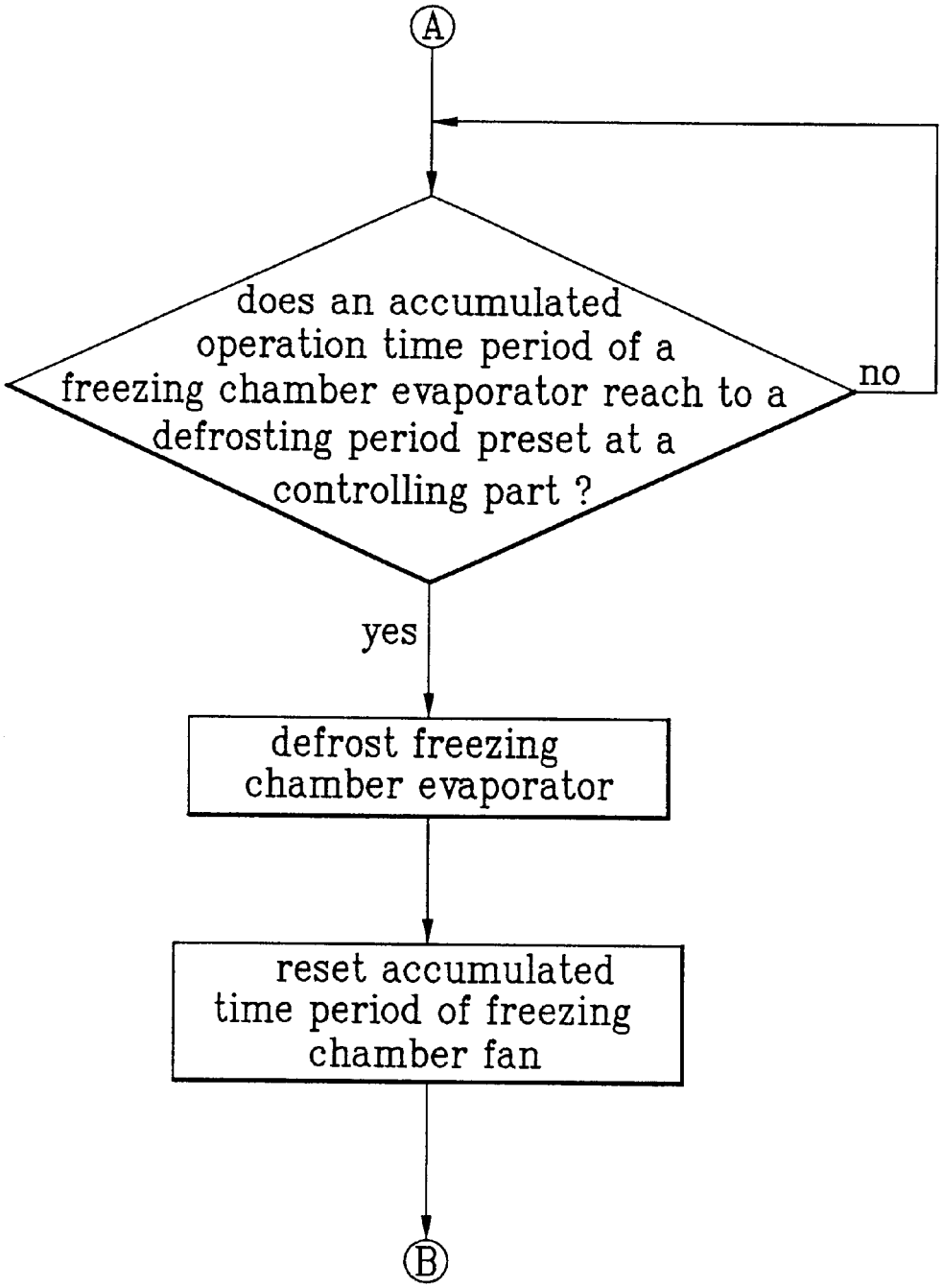

Referring to FIGS. 5A–5B, the storage chamber has a first storage chamber 7 and a second storage chamber 8, wherein, when both of the storage chambers 7 and 8 are operative under a kimchi fermenting mode for fermenting kimchi, even if the storage chamber evaporator 7*a* reaches to the defrosting period, the storage chamber evaporator 7*a* is not defrosted.

That is, when both the storage chambers 7 and 8 are operative under the kimchi fermenting mode, even if both the storage chamber evaporator 7*a* and the freezing chamber evaporator 6*a* reach to the defrosting periods, only the freezing chamber evaporator 6*a* is defrosted.

This is because no separate defrosting is required because the frost on the storage chamber evaporator 7*a* is melted by the storage chamber 7 and 8 temperatures maintained at approx. 20° C. in the fermenting mode caused by operation of a kimchi fermenting heater.

Since the storage chamber evaporator 7*a* is not defrosted when the storage chambers 7 and 8 are operated in the kimchi fermenting mode, the defrosting time period of the storage chamber evaporator 7*a* can be actually extended. Consequently, power consumption for operation of the defrosting heater in the defrosting and cooling down the evaporator again in the cooling down can be reduced.

The second embodiment and a variation thereof of the present invention progress the defrosting with reference to an accumulated operation time period of the compressor 1, which will be explained with reference to FIGS. 6A–9B.

Circles on straight lines in FIGS. 6A–7C represent defrosting time points of evaporators, and downward arrows from the circles represent modified defrosting time points.

The defrosting method according to the second embodiment of the present invention will be explained.

After defrosting periods of the freezing chamber evaporator 6*a* and the storage chamber evaporator 7*a* are set at the controlling part in advance, the controlling part accumulates an operation time period of the compressor 1, for defrosting the evaporator when the accumulated time period of the compressor reaches to the defrosting period of the evaporator set at the controlling part in advance.

It is assumed that Df denotes the defrosting time period of the freezing chamber evaporator 6*a*, and Cf denotes an operation time period of the compressor 1 accumulated from a time point the defrosting of the freezing chamber evaporator 6*a* is finished.

If a time point P3 the storage chamber evaporator 7*a* is reached to the defrosting time period meets a condition of Df−Cf<Df/4, both the freezing chamber evaporator 6*a* and the storage chamber evaporator 7*a* are defrosted on the same time, if the time point P3 the storage chamber evaporator 7*a* is reached to the defrosting time period meets a condition of Df/4<Df−Cf<Df/2, after operation of the freezing chamber evaporator 6*a* is extended by ½ of a time period from the defrosting time period reaching time point P3 to the next defrosting time point of the freezing chamber evaporator 6*a*, both the freezing chamber evaporator 6*a* and the storage chamber evaporator 7*a* are defrosted on the same time, or if a time point P3 the storage chamber evaporator 7*a* is reached to the defrosting time period meets a condition of Df/2<Df−Cf, only the storage chamber evaporator 7*a* is defrosted.

The foregoing defrosting method will be explained in more detail.

Figure 6A:
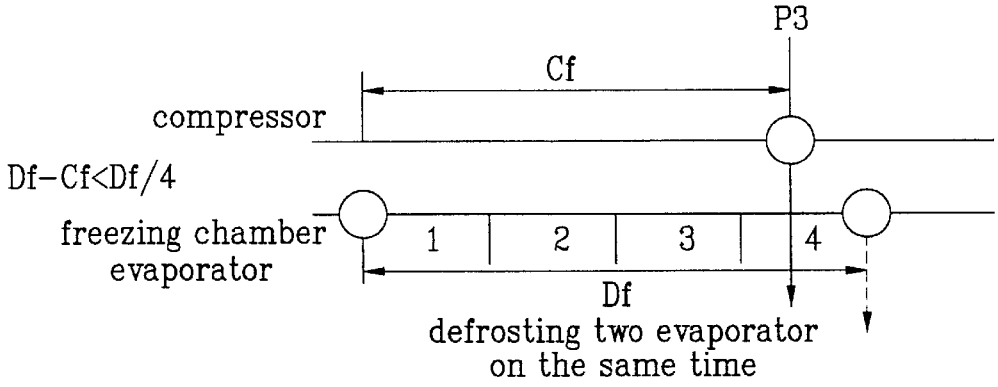
FIGS. 6A, 6B and 6C illustrate a diagram showing a method for defrosting respective evaporators according to an accumulated operation time period of a compressor from a time defrosting of a freezing chamber evaporator is finished in accordance with a second preferred embodiment of the present invention.

Referring to FIG. 6A, if the storage chamber evaporator 7*a* reaches to the defrosting period, before defrosting the storage chamber evaporator 7*a*, an operation time period Cf of the compressor accumulated from the defrosting of the freezing chamber evaporator is finished is determined. That is, if it is determined that the time point P3 the storage chamber evaporator is reached to the defrosting time period is within a fourth section of four equally divided defrosting periods of the freezing chamber evaporator 6*a* (Df−Cf<Df/4), the two evaporators are defrosted on the same time.

It can be noted that, if the time point P3 the storage chamber evaporator 7*a* is reached to the defrosting time period meets a condition of Df−Cf<Df/4, either the two evaporators are defrosted at a time point the storage chamber evaporator 7*a* is reached to the defrosting time period as shown in a solid line arrow in FIG. 6A, or the two evaporators are defrosted at a time point the freezing chamber evaporator 6*a* is reached to the defrosting period as shown in a dashed line.

According to this, an occasion is prevented, when the freezing chamber evaporator 6*a* is defrosted within a short time period the storage chamber evaporator 7*a* is defrosted.

Figure 6B:
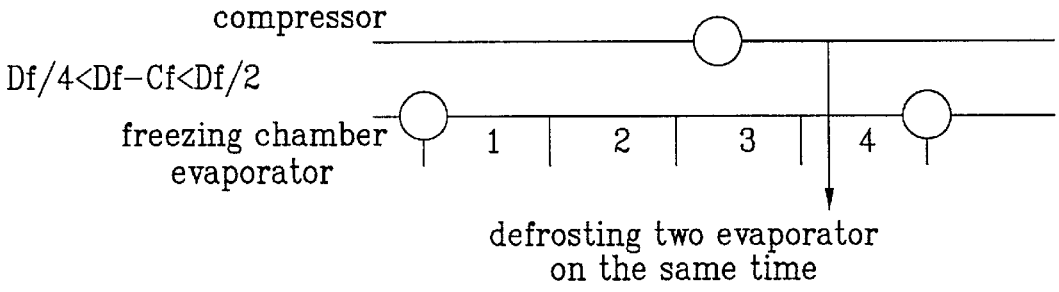

Or, if the time point P3 the storage chamber evaporator 7*a* is reached to the defrosting time period is determined to be within a third section of the four equally divided defrosting periods of the freezing chamber evaporator 6*a* (Df/4<Df−Cf<Df/2) as shown in FIG. 6B, the two evaporators are defrosted on the same time.

In this instance, by dividing a time period from the defrosting period reaching time point P3 to the next defrosting time point, extending operation of the storage chamber evaporator 7*a* by the one equally divided time period, and shortening operation of the freezing chamber evaporator 6*a* by the other one equally divided time period, the two evaporators can be defrosted on the same time. Of course, it can be noted that after operation of the storage chamber evaporator is extended for a preset time period, the two evaporators may be defrosted on the same time.

Referring to FIGS. 6A–6B, if it is determined that the defrosting time points of the storage chamber evaporator 7*a* and the freezing chamber evaporator 6*a* are close, the two evaporators are made to be defrosted on the same time.

Accordingly, it is possible that frequent repetition of an operation is prevented, in which the compressor stops for prevention of flow of refrigerant to the freezing chamber evaporator when the defrosting starts in the middle of R/F cycle operation of the refrigerator, and starts again for cooling down.

Figure 6C:
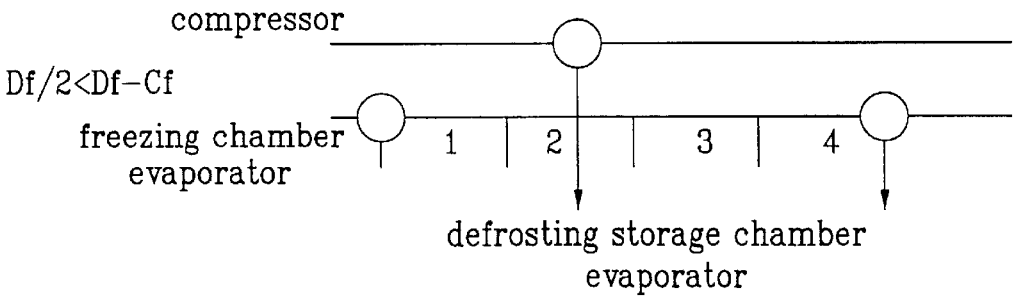

Referring to FIG. 6C, if the defrosting time point of the freezing chamber evaporator 6*a* is too far from the defrosting time point of the storage chamber evaporator 7*a*, the evaporators are defrosted, independently.

In the foregoing refrigerator defrosting methods, it can be noted that the operation methods shown in FIGS. 6A to 6C may be applied independently, or the three operation methods may be applied on the same time in the defrosting of the refrigerator.

A variation of the second embodiment of the present invention will be explained.

It is assumed that Dr denotes the defrosting time period of the storage chamber evaporator 7*a*, and Cr denotes an operation time period of the compressor 1 accumulated from a time point the defrosting of the storage chamber evaporator 7*a* is finished.

If a time point the freezing chamber evaporator 6*a* is reached to the defrosting time period meets a condition of Dr−Cr<Dr/4, both the freezing chamber evaporator 6*a* and the storage chamber evaporator 7*a* are defrosted on the same time, if the time point P4 the freezing chamber evaporator 6*a* is reached to the defrosting time period meets a condition of Dr/4<Dr−Cr<Dr/2, after operation of the freezing chamber evaporator 6*a* is extended by ½ of a time period from the defrosting period reaching time point P4 to the next defrosting time point of the storage chamber evaporator 7*a*, the freezing chamber evaporator 6*a* and the storage chamber evaporator 7*a* are defrosted on the same time, or if a time point P4 the freezing chamber evaporator 6*a* is reached to the defrosting time period meets a condition of Dr/2<Dr−Cr, only the freezing chamber evaporator 6*a* is defrosted.

The foregoing defrosting method will be explained in more detail.

Figure 7A:
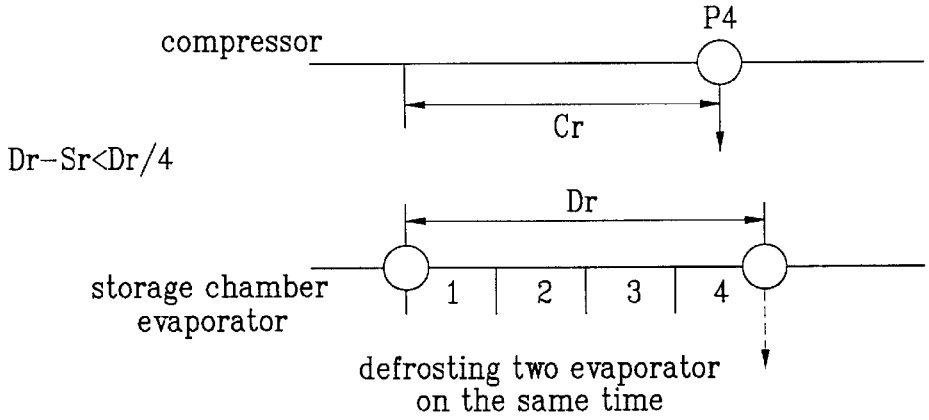
FIGS. 7A, 7B and 7C illustrate a diagram showing a method for defrosting respective evaporators according to an accumulated operation time period of a compressor from a time defrosting of a storage chamber evaporator is finished as a variation of FIGS. 6A, 6B and 6C.

Referring to FIG. 7A, if the freezing chamber evaporator 6*a* reaches to the defrosting time period, before defrosting the freezing chamber evaporator, an operation time period Cr of the compressor accumulated from a time point the defrosting of the storage chamber evaporator is finished is determined. That is, if it is determined that the time point P4 the freezing chamber evaporator is reached to the defrosting time period is within a fourth section of four equally divided defrosting periods of the storage chamber evaporator (Dr−Cr<Dr/4), the two evaporators are defrosted on the same time.

In this instance, either the two evaporators are defrosted at a time point the freezing chamber evaporator 6*a* is reached to the defrosting time period as shown a solid line arrow in FIG. 7A, or the two evaporators are defrosted at a time point the storage chamber evaporator 7*a* is reached to the defrosting period as shown in a dashed line arrow.

According to this, an occasion is prevented, when the storage chamber evaporator is defrosted within a short time period the freezing chamber evaporator is defrosted.

Figure 7B:
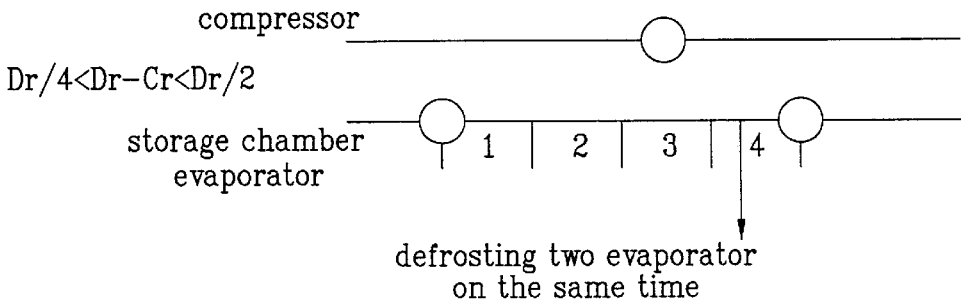

Or, if the time point P4 the freezing chamber evaporator 6*a* is reached to the defrosting time period is determined to be within a third section of the four equally divided defrosting periods of the storage chamber evaporator 7*a* (Dr/4<Dr–Cr<Dr/2) as shown in FIG. 7B, the two evaporators are defrosted on the same time.

In this instance, by dividing a time period from the defrosting period reaching time point P4 to the next defrosting time point of the storage chamber evaporator 7*a*, extending operation of the freezing chamber evaporator 6*a* by the one equally divided time period, and shortening operation of the storage chamber evaporator 7*a* by the other one equally divided time period, the two evaporators can be defrosted on the same time. Of course, it can be noted that, after operation of the storage chamber evaporator is extended by a preset time period, the two evaporators may be defrosted on the same time.

Referring to FIGS. 3A–3B, if it is determined that the defrosting time points of the storage chamber evaporator 7*a* and the freezing chamber evaporator 6*a* are close, the two evaporators are made to be defrosted on the same time.

Accordingly, it is possible that frequent repetition of an operation is prevented, in which the compressor stops for prevention of flow of refrigerant to the freezing chamber evaporator when the defrosting starts in the middle of R/F cycle operation of the refrigerator, and starts again for cooling down.

Figure 7C:
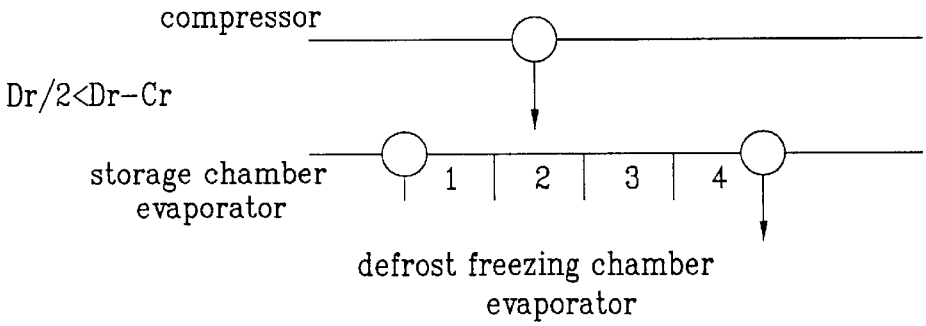

Referring to FIG. 7C, if the defrosting time point of the freezing chamber evaporator 6*a* is too far from the defrosting time point of the storage chamber evaporator 7*a*, the evaporators are defrosted, independently.

In the foregoing refrigerator defrosting methods, it can be noted that the operation methods shown in FIGS. 7A–7C may be applied independently, or, as explained, the three operation methods in FIGS. 7A–7C may be applied on the same time in the defrosting of the refrigerator.

Figure 8:
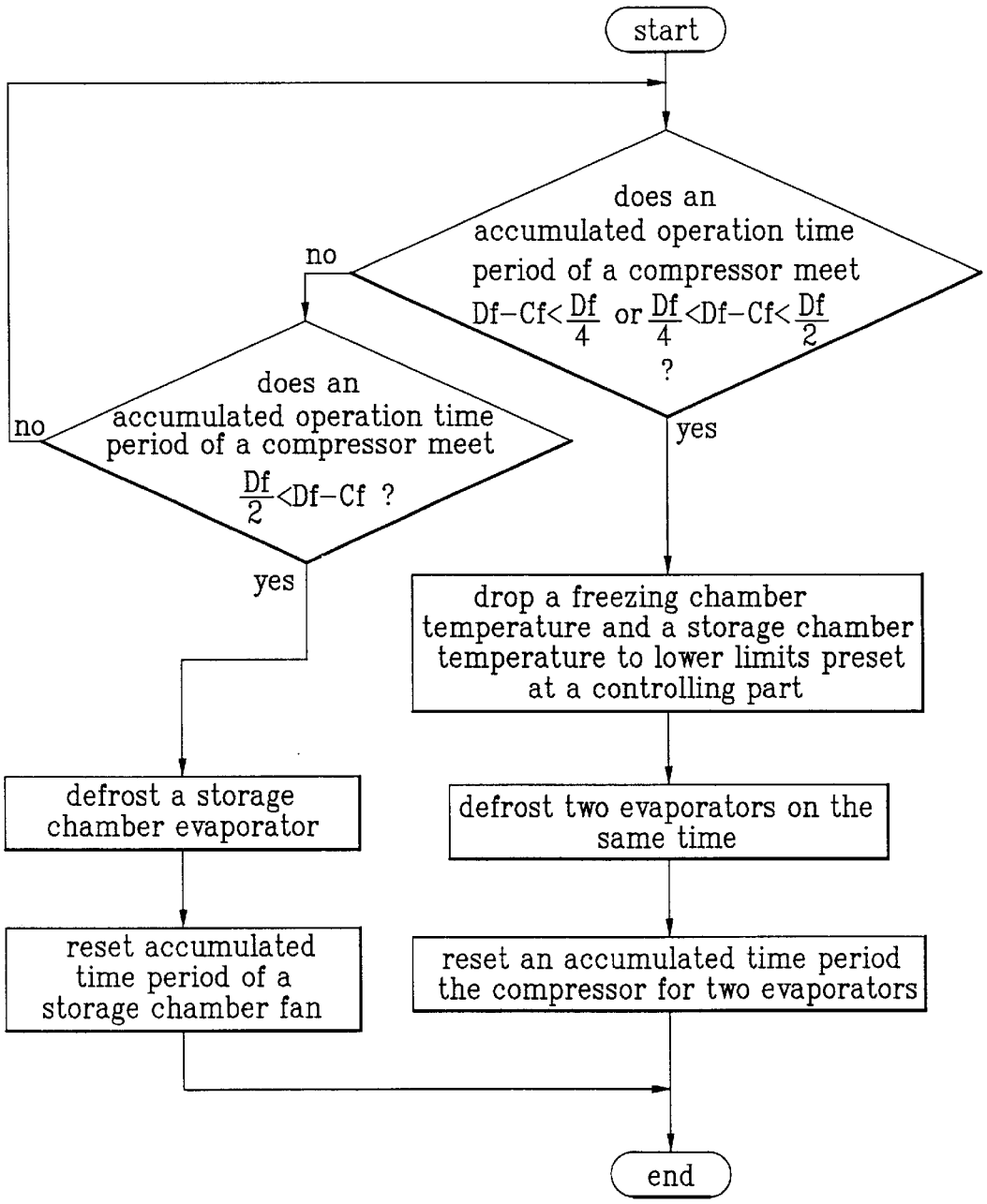
FIG. 8 illustrates a diagram showing a method for defrosting a refrigerator after temperatures of a freezing chamber and storage chambers are dropped to lower limit temperatures in accordance with a second preferred embodiment of the present invention.

Referring to FIG. 8, if it is intended to defrost the freezing chamber evaporator 6*a*, after temperatures of the freezing chamber 6 and the storage chambers 7 and 8 are dropped to lower limits of preset temperature ranges set at the controlling part, defrosting of the freezing chamber evaporator 6*a* is carried out. In this instance, since the refrigerant passes through the freezing chamber evaporator 6*a* even if the refrigerator is in operation in any one of the F or R/F cycle, it is required that either the two evaporators 6*a* and 7*a* are defrosted on the same time, or the compressor 1 is stopped if the freezing chamber evaporator 6*a* only is defrosted.

Accordingly, as the freezing chamber 6 and the storage chambers 7 and 8 heat exchange with outside air from a time defrosting of the freezing chamber evaporator 6*a* starts to a time cooling operation of the freezing chamber evaporator 6*a* starts again, rising of the freezing chamber temperature and the storage chamber temperature over upper limits of the preset temperature ranges is prevented.

Eventually, as stable maintenance of the freezing chamber 6 temperature and the storage chamber 7, and 8 temperatures within preset temperature ranges is possible, inherent tastes of food, such as meats and kimchi stored in the freezing chamber 6 and the storage chambers can be maintained for a more long time.

Figure 9A:
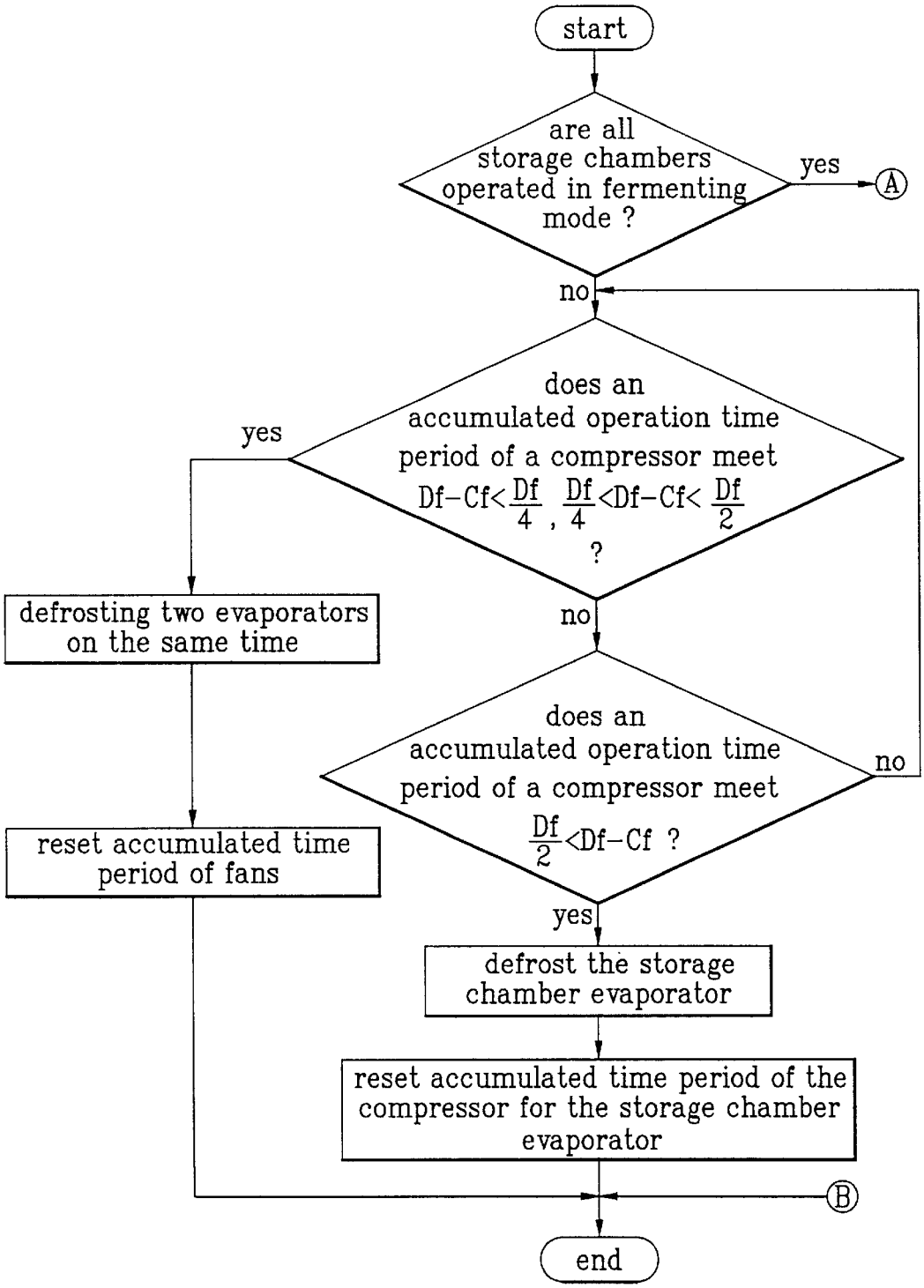
FIGS. 9A and 9B illustrate a diagram showing a method for defrosting a refrigerator when all the storage chambers are operative in fermenting modes in accordance with a second preferred embodiment of the present invention.
Figure 9B:
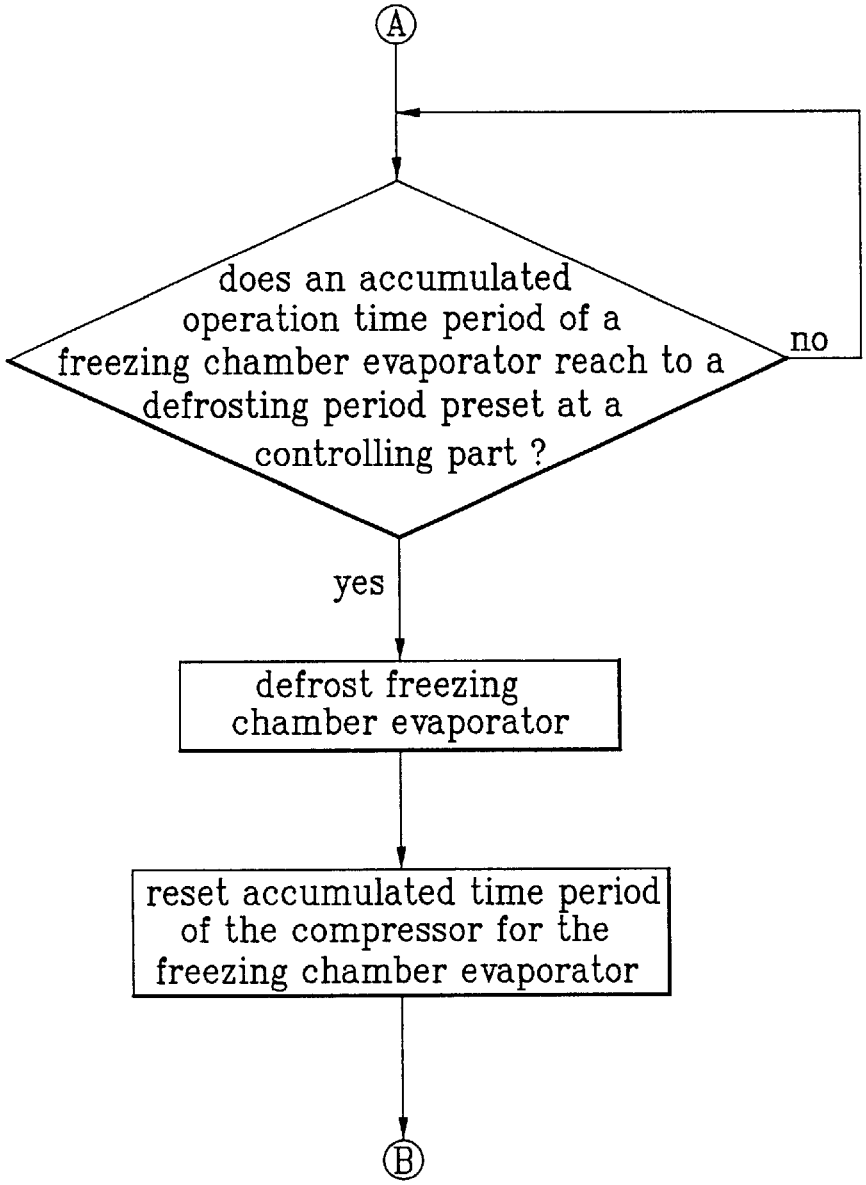

Referring to FIGS. 9A–9B, when the storage chambers 7 and 8 are operative under a kimchi fermenting mode for fermenting kimchi, even if the accumulated operation time period of the compressor 1 reaches to the defrosting period of the storage chamber evaporator 7*a*, the storage chamber evaporator 7*a* is not defrosted.

That is, when both the storage chambers 7 and 8 are operative under the kimchi fermenting mode, despite both the storage chamber evaporator 7*a* and the freezing chamber evaporator 6*a* reach to the defrosting periods, only the freezing chamber evaporator 6*a* is defrosted.

This is because no separate defrosting is required because the frost on the storage chamber evaporator 7*a* is melted by the storage chamber 7 and 8 temperatures maintained at approx. 20° C. in the fermenting mode caused by operation of a kimchi fermenting heater.

As explained, since the storage chamber evaporator 7*a* is not defrosted when the storage chambers 7 and 8 are operated in the kimchi fermenting mode, the defrosting time period of the storage chamber evaporator 7*a* can be actually extended.

As explained, the method for defrosting a refrigerator with two evaporators is explained taking a case as an example, in which each defrosting period of evaporators is divided into four sections, and the evaporators are defrosted on the same time when the defrosting time points of the evaporators are close.

However, the technical aspect of the present invention is not limited to the four division of the defrosting time period, but division of the defrosting time period into a plurality of sections, for defrosting the evaporators on the same time if the defrosting times are close.

The method for defrosting a refrigerator with two evaporators of the present invention has the following advantages.

First, the simultaneous defrosting of two evaporators when defrosting time points of the evaporators are close can prevent frequent repetition of stopping and starting of the compressor, thereby permitting a pressure loss of the compressor and reducing a power consumption required for the frequent stopping and starting of the compressor.

Second, the defrosting of the freezing chamber evaporator after the freezing chamber and the storage chamber are cooled down to temperature lower limits can prevent temperatures of the freezing chamber and the storage chamber from rising up to temperature upper limits, thereby permitting more stable operation of the freezing chamber and the storage chamber within preset temperature ranges, that in turn permits storage of kimchi, vegetables, and meat stored in the freezing chamber and the storage chambers for a long time under a fresh state, and to maintain tastes of the kimchi fermented to suit to the tastes of consumers in the storage chambers for a long time.

Third, unnecessary defrosting is eliminated by making the storage chamber evaporator not to be defrosted even if the storage chamber evaporator reaches to the defrosting period in a case all the storage chambers are operative under a kimchi fermenting mode.

It will be apparent to those skilled in the art that various modifications and variations can be made in the method for defrosting a refrigerator with two evaporators of the present invention without departing from the spirit or scope of the invention. Thus, it is intended that the present invention cover the modifications and variations of this invention provided they come within the scope of the appended claims and their equivalents.

What is claimed is:

1. A method for defrosting a refrigerator with two evaporators, in which a controlling part accumulates operation time periods of a freezing chamber fan and a storage chamber fan respectively, and defrosts a relevant evaporator if the accumulated time period of the fan reaches to a defrosting period preset at the controlling part, comprising the steps of:

if a time point P1 a storage chamber evaporator is reached to the defrosting time period meets a condition of Df−Sf<Df/4, defrosting both the freezing chamber evaporator and the storage chamber evaporator on the same time;

if the time point P1 the storage chamber evaporator is reached to the defrosting time period meets a condition of Df/4<Df−Sf<Df/2, after operation of the freezing chamber evaporator is extended by ½ of a time period from the defrosting time period reaching time point P1 to the next defrosting time point of the freezing chamber evaporator, defrosting both the freezing chamber evaporator and the storage chamber evaporator on the same time; and if the time point P1 the storage chamber evaporator is reached to the defrosting time period meets a condition of Df/2<Df−Sf, defrosting only the storage chamber evaporator, where, Df denotes the defrosting time period of the freezing chamber evaporator, and Sf denotes an operation time period of the storage chamber evaporator fan accumulated from a time point the defrosting of the freezing chamber evaporator is finished.

2. A method as claimed in claim 1, wherein, if the time point P1 the storage chamber evaporator is reached to the defrosting time period meets a condition of Df−Sf<Df/4, the two evaporators are defrosted on the same time at one of time points the storage chamber evaporator reaches to the defrosting period, and the freezing chamber evaporator reaches to the defrosting period.

3. A method as claimed in claim 1, wherein, when it is intended that the freezing chamber evaporator is defrosted, after the freezing chamber temperature and the storage chamber temperature are dropped to lower limits of temperature ranges preset at the controlling part, the freezing chamber evaporator is defrosted.

4. A method as claimed in claim 3, wherein the compressor is stopped when the freezing chamber evaporator is defrosted.

5. A method as claimed in claim 1, wherein, when the storage chamber is operative in a kimchi fermenting mode for fermenting kimchi, it is made that the storage chamber evaporator is not defrosted even if the storage chamber evaporator reaches to the defrosting period.

6. A method for defrosting a refrigerator with two evaporators, in which a controlling part accumulates operation time periods of a freezing chamber fan and a storage chamber fan respectively, and defrosts a relevant evaporator if the accumulated time period of the fan reaches to a defrosting period preset at the controlling part, comprising the steps of:

if a time point P2 a freezing chamber evaporator is reached to the defrosting time period meets a condition of Dr−Sr<Dr/4, defrosting both the freezing chamber evaporator and the storage chamber evaporator on the same time;

if the time point P2 the freezing chamber evaporator is reached to the defrosting time period meets a condition of Dr/4<Dr−Sr<Dr/2, after operation of the storage chamber evaporator is extended by ½ of a time period from the defrosting time period reaching time point P2 to the next defrosting time point of the storage chamber evaporator, defrosting both the freezing chamber evaporator and the storage chamber evaporator on the same time; and if the time point P2 the freezing chamber evaporator is reached to the defrosting time period meets a condition of Dr/2<Dr−Sr, defrosting only the freezing chamber evaporator, where, Dr denotes the defrosting time period of the storage chamber evaporator, and Sr denotes an operation time period of the freezing chamber evaporator fan accumulated from a time point the defrosting of the storage chamber evaporator is finished.

7. A method as claimed in claim 6, wherein, if the time point P2 the freezing chamber evaporator is reached to the defrosting time period meets a condition of Dr−Sr<Dr/4, the two evaporators are defrosted on the same time at one of time points the storage chamber evaporator reaches to the defrosting period, and the freezing chamber evaporator reaches to the defrosting period.

8. A method as claimed in claim 6, wherein, when it is intended that the freezing chamber evaporator is defrosted, after the freezing chamber temperature and the storage chamber temperature are dropped to lower limits of temperature ranges preset at the controlling part, the freezing chamber evaporator is defrosted.

9. A method as claimed in claim 8, wherein the compressor is stopped when the freezing chamber evaporator is defrosted.

10. A method as claimed in claim 6, wherein, when the storage chamber is operative in a kimchi fermenting mode for fermenting kimchi, it is made that the storage chamber evaporator is not defrosted even if the storage chamber evaporator reaches to the defrosting period.

11. A method for defrosting a refrigerator with two evaporators, in which a controlling part accumulates operation time periods of a freezing chamber fan and a storage chamber fan respectively, and defrosts a relevant evaporator if the accumulated time period of the fan reaches to a defrosting period preset at the controlling part, comprising the steps of:

if a time point P3 a storage chamber evaporator is reached to the defrosting time period meets a condition of Df−Cf<Df/4, defrosting both the freezing chamber evaporator and the storage chamber evaporator on the same time;

if the time point P3 the storage chamber evaporator is reached to the defrosting time period meets a condition of Df/4<Df−Cf<Df/2, after operation of the freezing chamber evaporator is extended by ½ of a time period from the defrosting time period reaching time point P3 to the next defrosting time point of the freezing chamber evaporator, defrosting both the freezing chamber evaporator and the storage chamber evaporator on the same time; and if the time point P3 the storage chamber evaporator is reached to the defrosting time period meets a condition of Df/2<Df−Cf, defrosting only the storage chamber evaporator, where, Df denotes the defrosting time period of the freezing chamber evaporator, and Cf denotes an operation time period of the compressor accumulated from a time point the defrosting of the freezing chamber evaporator is finished.

12. A method as claimed in claim 11, wherein, if the time point P3 the storage chamber evaporator is reached to the defrosting time period meets a condition of $Df-Cf<Df/4$, the two evaporators are defrosted on the same time at one of time points the storage chamber evaporator reaches to the defrosting period, and the freezing chamber evaporator reaches to the defrosting period.

13. A method as claimed in claim 11, wherein, when it is intended that the freezing chamber evaporator is defrosted, after the freezing chamber temperature and the storage chamber temperature are dropped to lower limits of temperature ranges preset at the controlling part, the freezing chamber evaporator is defrosted.

14. A method as claimed in claim 13, wherein the compressor is stopped when the freezing chamber evaporator is defrosted.

15. A method as claimed in claim 11, wherein, when the storage chamber is operative in a kimchi fermenting mode for fermenting kimchi, it is made that the storage chamber evaporator is not defrosted even if the storage chamber evaporator reaches to the defrosting period.

16. A method for defrosting a refrigerator with two evaporators, in which a controlling part accumulates operation time periods of a freezing chamber fan and a storage chamber fan respectively, and defrosts a relevant evaporator if the accumulated time period of the fan reaches to a defrosting period preset at the controlling part, comprising the steps of:

if a time point P4 a freezing chamber evaporator is reached to the defrosting time period meets a condition of $Dr-Cr<Dr/4$, defrosting both the freezing chamber evaporator and the storage chamber evaporator on the same time;

if the time point P4 the freezing chamber evaporator is reached to the defrosting time period meets a condition of $Dr/4<Dr-Cr<Dr/2$, after operation of the storage chamber evaporator is extended by ½ of a time period from the defrosting time period reaching time point P2 to the next defrosting time point of the storage chamber evaporator, defrosting both the freezing chamber evaporator and the storage chamber evaporator on the same time; and if the time point P4 the freezing chamber evaporator is reached to the defrosting time period meets a condition of $Dr/2<Dr-Cr$, defrosting only the freezing chamber evaporator, where, Dr denotes the defrosting time period of the storage chamber evaporator, and Cr denotes an operation time period of the compressor accumulated from a time point the defrosting of the storage chamber evaporator is finished.

17. A method as claimed in claim 16, wherein, if the time point P4 the freezing chamber evaporator is reached to the defrosting time period meets a condition of $Dr-Cr<Dr/4$, the two evaporators are defrosted on the same time at one of time points the storage chamber evaporator reaches to the defrosting period, and the freezing chamber evaporator reaches to the defrosting period.

18. A method as claimed in claim 16, wherein, when it is intended that the freezing chamber evaporator is defrosted, after the freezing chamber temperature and the storage chamber temperature are dropped to lower limits of temperature ranges preset at the controlling part, the freezing chamber evaporator is defrosted.

19. A method as claimed in claim 18, wherein the compressor is stopped when the freezing chamber evaporator is defrosted.

20. A method as claimed in claim 16, wherein, when the storage chamber is operative in a kimchi fermenting mode for fermenting kimchi, it is made that the storage chamber evaporator is not defrosted even if the storage chamber evaporator reaches to the defrosting period.

* * * * *